United States Patent [19]

Seebach, Jr.

[11] 4,397,170

[45] Aug. 9, 1983

[54] DOUBLE FEED EYELET MACHINE WITH ROLL FORMING CAPABILITY

[75] Inventor: Henry F. Seebach, Jr., Middlebury, Conn.

[73] Assignee: Eyelematic Manufacturing Company, Watertown, Conn.

[21] Appl. No.: 301,978

[22] Filed: Sep. 14, 1981

[51] Int. Cl.[3] ..... B21D 43/05

[52] U.S. Cl. ..... 72/68; 72/105; 72/107

[58] Field of Search ..... 72/67, 68, 105, 106, 72/107, 336, 337, 405, 703

[56] References Cited

U.S. PATENT DOCUMENTS

| | | | |
|---|---|---|---|
| 959,825 | 5/1910 | Warwick | 72/68 |
| 2,281,554 | 5/1942 | Calleson et al. | 72/405 |
| 2,837,015 | 6/1958 | Chundelak, Jr. et al. | 72/68 |

*Primary Examiner*—Lowell A. Larson

*Attorney, Agent, or Firm*—St. Onge, Steward, Johnston & Reens

[57] ABSTRACT

Modification of a standard commercial multistation transfer press is disclosed to provide greater output capacity from that press, especially in producing workpieces which require a rolling operation in the forming process. The modified press utilizes double feed rolls of sheet metal strip, and pairs of duplicate blanking, drawing and rolling stations for processing the workpieces in pairs while being advanced through the press to complete the work.

6 Claims, 9 Drawing Figures

Fig. 1.
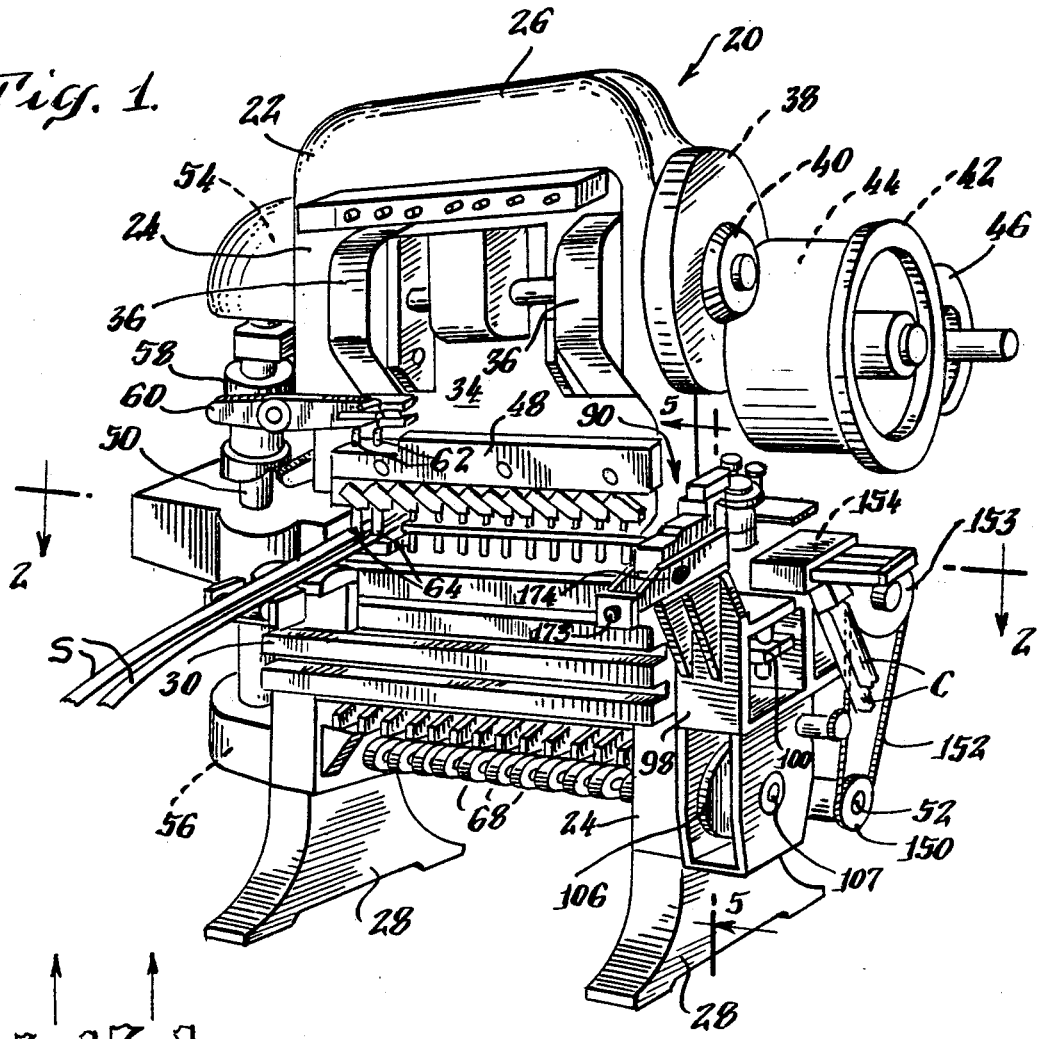
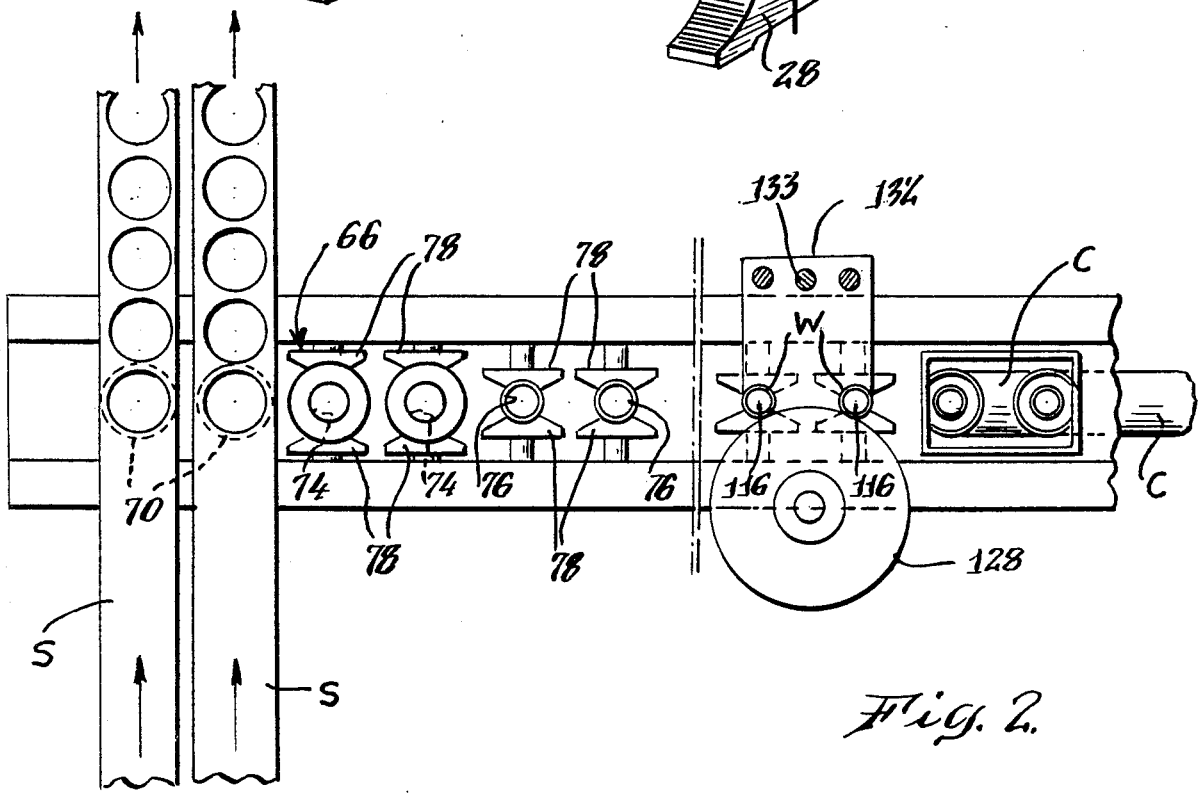
Fig. 2.

DOUBLE FEED EYELET MACHINE WITH ROLL FORMING CAPABILITY

BACKGROUND OF THE INVENTION

1. Field of the Invention

This invention relates to improvements in multistation sheet metal transfer press equipment, and more particularly to so-called eyelet presses adapted to blank out and then progressively form relatively small to medium sized parts from strips of sheet metal stock.

2. Discussion of the Prior Art

Multiple station metal stamping apparatus has long been used in the mass production of a wide variety of metal parts. In general the apparatus is adapted to stamp a blank or disc-like piece from a strip of sheet metal stock introduced at a first station of the press, and to advance the resulting piece through a succession of shaping or forming operations, in stepwise manner at sequential forming stations arranged along a press bed. One type of transfer press commercially available employs a driveshaft about which a plurality of cams is angularly secured to cooperate with adjustable cam followers, the several cams being located at respective forming stations of the press. Punch members of tool and die sets at each of the forming stations are reciprocated by the cams with each revolution of the driveshaft to provide the punching or drawing operation on the workpieces. Transfer mechanism on the press bed is provided to advance the workpieces stepwise through the various tool stations to a point of discharge. Presses of this type are shown in U.S. Pat. Nos. 3,369,387 and 3,683,665, for example.

In another type of commercially available press, all of the punches of the several tool and die sets are mounted to be operated simultaneously by a single horizontally disposed heavy ram. This is reciprocated vertically by matched precision-ground cams engaging opposite ends of the ram to raise and lower it with each revolution of the driveshaft by which the cams are driven. Again the reciprocating motion is used to operate the punches of the tool sets at each station of the press. This form of press is shown for example in U.S. Pat. Nos. 2,049,915 and 4,166,372. The invention here is designed more particularly for use in the latter type of press.

Various modifications of these transfer presses have been developed by the trade in terms of how the sheet metal feed stock is fed to and the workpieces are progressed through the forming stations. Such modifications include arrangements in which dual strips are fed first to duplicate blanking stations, and the workpieces are then transferred, pair-wise, from one station to the next. In U.S. Pat. No. 3,369,387 mentioned above, the duplicate stations are paired on opposite sides of a central transverse plane of the press, with the feed stock entering at opposite ends of the press, while the workpiece forming operations progress inwardly toward that central plane to discharge the finished product at that point. In U.S. Pat. No. 3,683,665, also mentioned above, the sheet stock material is fed centrally of the tool line in the press (i.e., at the central transverse plane), and duplicate blanks punched from the strips at the first pair of stations are then transferred pair-wise but in opposite directions outwardly from that central plane through the several paired tool stations toward opposite ends of the press. That is, in this type of press, the duplicate stations are paired so as to be equidistant from but on opposite sides of that central plane.

In U.S. Pat. Nos. 3,461,708 and 3,650,141, the presses illustrated embody duplicate sets of forming tools, but these are paired in adjacent sets transversely of the direction of workpiece travel, rather than longitudinally of it as in the patents just mentioned. That is, they are paired across a vertical plane running longitudinally of the press bed. Similarly, U.S. Pat. No. 3,800,583 shows an arrangement of duplicate tool sets in which the tools at each station are paired transversely of the workpiece travel, similar to the arrangement in the last-mentioned patents but incorporating the center fed arrangement of a machine such as that shown in U.S. Pat. No. 3,683,665.

While this prior art shows double-feed arrangements for punch and draw work, none of it mentions roll forming.

SUMMARY OF THE INVENTION

These multistage stamping presses are large pieces of machinery occupying considerable space on a factory floor, and incorporate many and somewhat complex operating parts. Needless to say, even one of these presses represents a substantial capital investment, and manufacturers of the presses accordingly offer them only in a limited range of sizes or tonnage capacity. While standards of size have been selected to meet the work capacity which experience has shown will accommodate a majority of parts generally produced with this kind of press, many times an available press in a metal fabricating shop will not be adequate for a particular job. In such case a second, supplementing press has to be employed. This involves tying-up two presses on one job and means also that there must be a workpiece transfer from one press to another. This is inconvenient and inefficient. The alternative is for the manufacturer to purchase an entirely new press having the larger capacity and special work-handling requirements of that particular job. Often this is simply not economically feasible.

Where a given workpiece requires not only blanking and drawing operations to be performed during its fabrication, but also a rolling operation, the standard eyelet presses available have not been readily adaptable by a press shop tool room to permit multi-feed (i.e., double strip feed) operation, as commonly could be desired to secure the benefit of added production from a single press that such arrangement can afford.

In this invention, the novel press is designed successively to process duplicate workpieces at paired stations at one of which a rolling operation is performed, with all of the stations being aligned as is standard in a single file along the press bed, parallel to the ram. In the novel press two strips of sheet metal feed stock from coils thereof are fed to duplicate stations at a first end of the press bed, and the duplicate workpieces formed at a first pair of adjacent stations are advanced, pair-wise, to successive stations. In order to accomplish this, transfer means effecting the advance of the work moves each piece twice the spacing between adjacent stations.

The invention here is directed particularly to the incorporation in an otherwise generally standard multistation press of paired tooling for effecting a rolling, thread forming or similar rotary forming operation on the articles being produced.

One of the objects of the invention is to reduce the need for employing a press simply to perform, as a secondary operation, a rolling operation on a workpiece, thus eliminating the inefficiency of employing two presses and the nuisance of transporting partially fabricated parts from one press and orienting them for proper feed to a secondary press.

It is a further object of the invention to enable greater flexibility of utilization of an available press, and also to improve the production rate of workpieces from a given multistation eyelet machine, especially where a rolling or thread forming operation must be included with the usual blanking, cuping and similar axially oriented forming operations, relative to tool movement.

These and other objects of the invention will become more apparent from the following description of a press, selected for illustrative purposes only, modified to incorporate the present invention. Other modifications and specific embodiments of the invention are of course possible and the scope of the inventive concept is limited only by the claims forming a part of this disclosure.

SHORT DESCRIPTION OF THE DRAWINGS

FIG. 1 is a perspective view of a standard type of eyelet press, looking at it from the feed side, modified to incorporate the invention;

FIG. 2 is a plan view, foreshortened and in section generally along line 2—2 in FIG. 1, showing the press bed, workpiece transfer means and dies at some of the stations of the press, the double rolling station in accordance with the invention being shown only schematically;

DESCRIPTION OF THE PREFERRED EMBODIMENT

Figure 3:
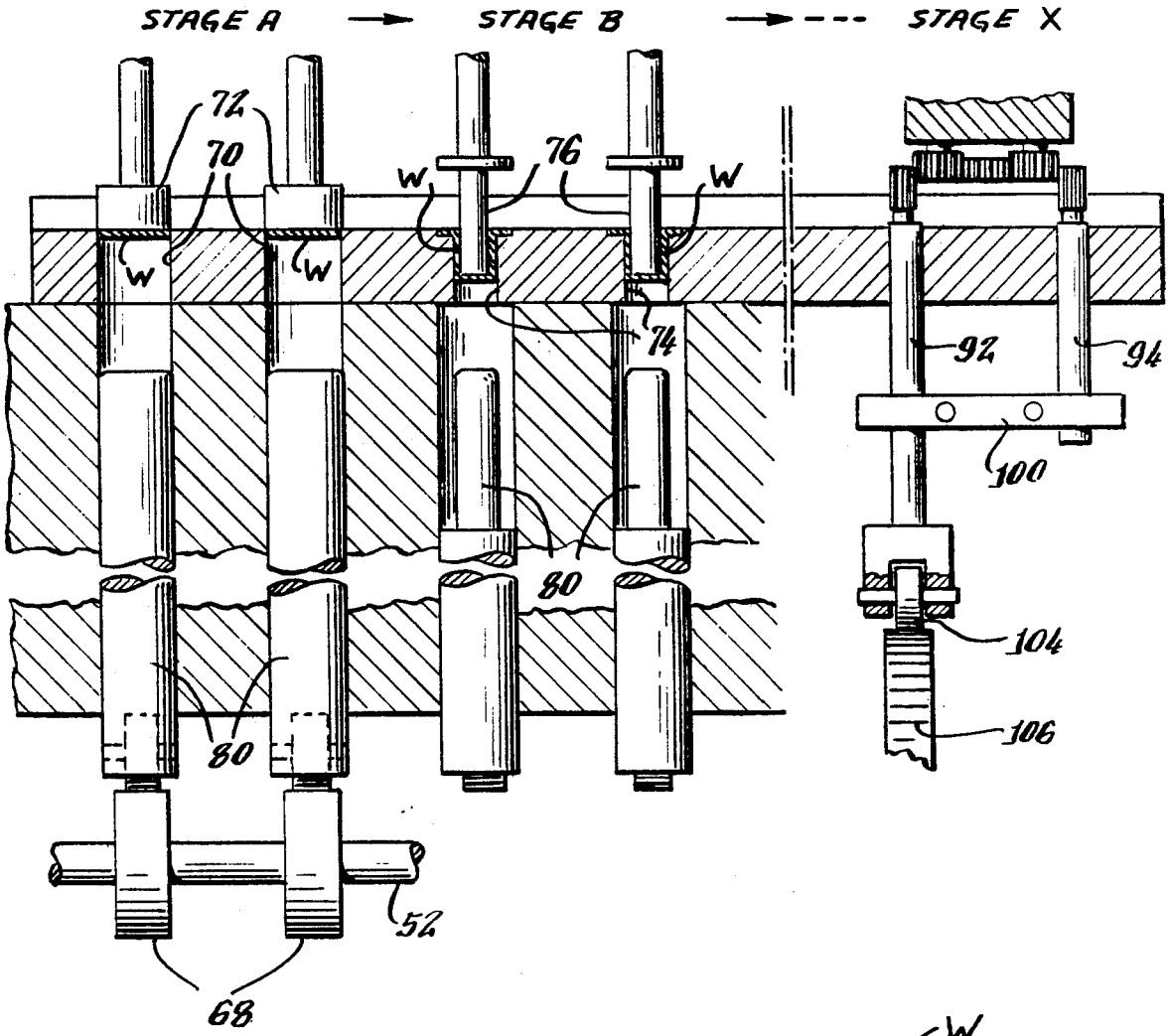
FIG. 3 is a fragmentary sectional view in side elevation, showing in simplified schematic form several of the paired tool stations along the press bed.

The type of press to which the invention is applicable is generally shown in FIG. 1. Press 20 comprises an inverted, generally U-shaped, main frame 22 having heavy vertical side walls or posts 24 spaced to support tooling intermediate them and connected at their upper end by a heavy crown or bridging member 26. The lower ends of side walls 24 are formed to provide feet 28 for supporting the frame stably in upright position. A heavy press bed 30 is secured horizontally between the side walls above feet 28. Bed 30 supports the die members of the punch and die sets comprising the work fabricating tool portion of the press, as well as transfer fingers for advancing the workpieces from station to station, as will appear more fully presently but which in any event is conventional.

Frame 20 also carries a cam shaft 32 journaled in suitable bearings in side walls 24, near the upper end of the frame. Shaft 32 is provided with large precision ground cams (not shown) secured to the shaft at the inside of each wall 24. These provide vertical reciprocating motion to a ram 34 through appropriate cam follower means not specifically shown but housed within housing members 36 as seen in FIG. 1. Cam shaft 32 is rotated through a drive train including a large bull gear 38 housed adjacent the outer face of the right side wall 24 as seen in FIG. 1, a housed driving pinion 40, flywheel 42 and interconnecting clutch mechanism 44, by an electric motor 46 also mounted on the frame. Reciprocation of ram 34 is confined to vertical motion by suitable guideways on the opposing inner faces of side walls 24, and the ram is provided with a heavy punch block 48 for mounting the punch members of the punch and die sets. An auxiliary shaft 50 is also journaled on frame 22, parallel to the outer face of left side wall 24. This interconnects the main shaft with a knockout cam shaft 52, running parallel to the main cam shaft 32 but located below press bed 30. Housed bevel gears 54, 56 at the upper and lower ends of auxiliary shaft 50 respectively transmit driving power from the main to the knockout shaft. Auxiliary shaft 50 serves also, through cam 58 and cam follower means 60, to reciprocate a pair of cupping punches 62 independently of but in timed sequence with blanking punches 64 carried by punch block 48. Shaft 50 also provides power for operating transfer finger mechanism 66 which is located on top of the press bed 30 and reciprocates lengthwise thereof to effect stepwise advancement of the metal workpieces through the required sequence of forming operations involved in fabricating the final product. Cams 68, one for each station of the press, on shaft 52 cooperate with respective knockout punches mounted in press bed 30 at the respective stations to eject the workpieces from their corresponding die recesses after each forming step is completed during operation of the press.

So much of the press structure just described is generally standard and well understood by those utilizing eyelet press machinery. The abreviated description provided above will accordingly suffice for those skilled in this art to have an understanding of that part of the present invention.

As mentioned before, where the nature of the workpiece to be produced on a given press permits advantage to be taken of a double feed arrangement, the tooling for the press is designed to provide duplicate punch and die sets for each successive forming stage of the product. The various options mentioned earlier for effecting double feed all employ pairing, in one manner or another, of the punch and die sets for the successive fabricating stages. However, it is an important object of this invention to provide a press arrangement that not only incorporates double feed, but also permits incorporation at a pair of tool stations of means for effecting a rotary or rolling operation on the workpiece, supplementing the usual blanking and drawing operations effected by lineal reciprocation of the punch and die tooling, all in the same press. Presses heretofore available have not provided nor been readily adapted by a fabricating shop for meeting this combination of requirements. The combination of features now to be described in the further discussion of the accompanying drawings illustrates one way of incorporating the concept of this invention into an otherwise commercially available eyelet press.

Again, with reference to FIGS. 1 to 3, press 20 is tooled to accept double strip feed of sheet metal stock, from coils thereof not shown in the drawings. The feed and progression of resulting workpieces at each stage of their fabrication starts at the lefthand end of the bed as seen in the drawings and moves linearly to the right-hand end of the bed. The tools are arranged in paired, duplicate sets, at each stage of fabrication. See more particularly FIGS. 2 and 3. At each stage, both sets of the paired punch and die members perform identical forming operations on the workpieces W located at that stage. For example, at Stage A, each strip of sheet metal S is subjected to a blanking operation to cut a circular disc of metal from each strip, and this blank is further formed at the same station into a shallow cup. Thus both dies 70 and punches 72 at Stage A are duplicates of each other. Similarly, the two sets of dies and punches 74, 76, respectively, at the tool stations of Stage B are identical to each other and serve to perform a further identical forming operation (a drawing operation as here illustrated) upon workpieces transferred from Stage A. Transfer is accomplished in known manner by opposed "fingers" 78 of transfer mechanism 66 which grip the workpieces as they are pushed up out of dies 70 or 74 by knockout plungers 80 operated by cams 68 in timed sequence with the withdrawal of the respective punches 72, 76. Mechanism 66 is caused by a cam (not shown) on auxiliary shaft 50 to reciprocate to the right on press bed 30, indexing each pair of workpieces from Stage A to Stage B, etc. to Stage X. Each workpiece accordingly moves to the right the full distance between its position at one stage and the corresponding position at the next stage. Where the distance between each tool set is uniform along the press bed, as is usual, the transfer distance is of course simply twice the distance between adjacent tool stations. At the conclusion of the transfer, the respective workpieces are released by fingers 78 and these latter return to their original positions, ready for the cycle to be repeated. Delivery of the workpieces to successive stations is timed to coordinate with the punch stroke of the respective punches 72, 76, etc. at all of the tool stations so that each workpiece W is contacted by its die and guided into the die openings before being fully released by transfer fingers 78. This ensures proper registration of the work with the tools as each forming operation is accomplished.

The number of paired sets of tools (i.e., the number of forming stages) will vary with the size and shape of the workpiece, the type of metal of which it is made, and of course the number of tool stations provided on a given press. The invention here supplements the standard available press by addition of a double rolling stage, designated Stage X in the accompanying drawings, more particularly FIGS. 2 and 3. The tooling at this stage is again identical at each of the two rolling stations and is arranged to receive workpieces advanced by transfer mechanism 66 of the press from the immediately preceding stage in order to perform roll forming operations on the work. To this end, a pair of auxiliary plungers is mounted for vertical reciprocation beneath an extension of the press bed 30, coinciding with the final tool stations.

These plungers are reciprocated by auxiliary cam means to push the workpieces upwardly from the transfer fingers holding them, to engage work arbors supported above the press bed, with their free ends projecting downwardly in vertical axial alignment with the plungers. The workpieces are engaged by the arbors before being completely free of the transfer fingers so that the workpieces do not become misaligned and dropped or damaged in the transfer. These arbors are positioned to cooperate with a single forming roll, the periphery of whose surface is configured to form the desired impression in the workpieces during the roll forming operation. At the conclusion of the rolling operation, the aforesaid plungers retract, simultaneously releasing spring-loaded stripper means which extracts the finished workpieces from the depending free ends of their arbors, causing them to drop into chutes for delivery to storage barrels. Further details of the roll forming mechanism at Stage X are described below for a fuller understanding of the invention.

Figure 4:
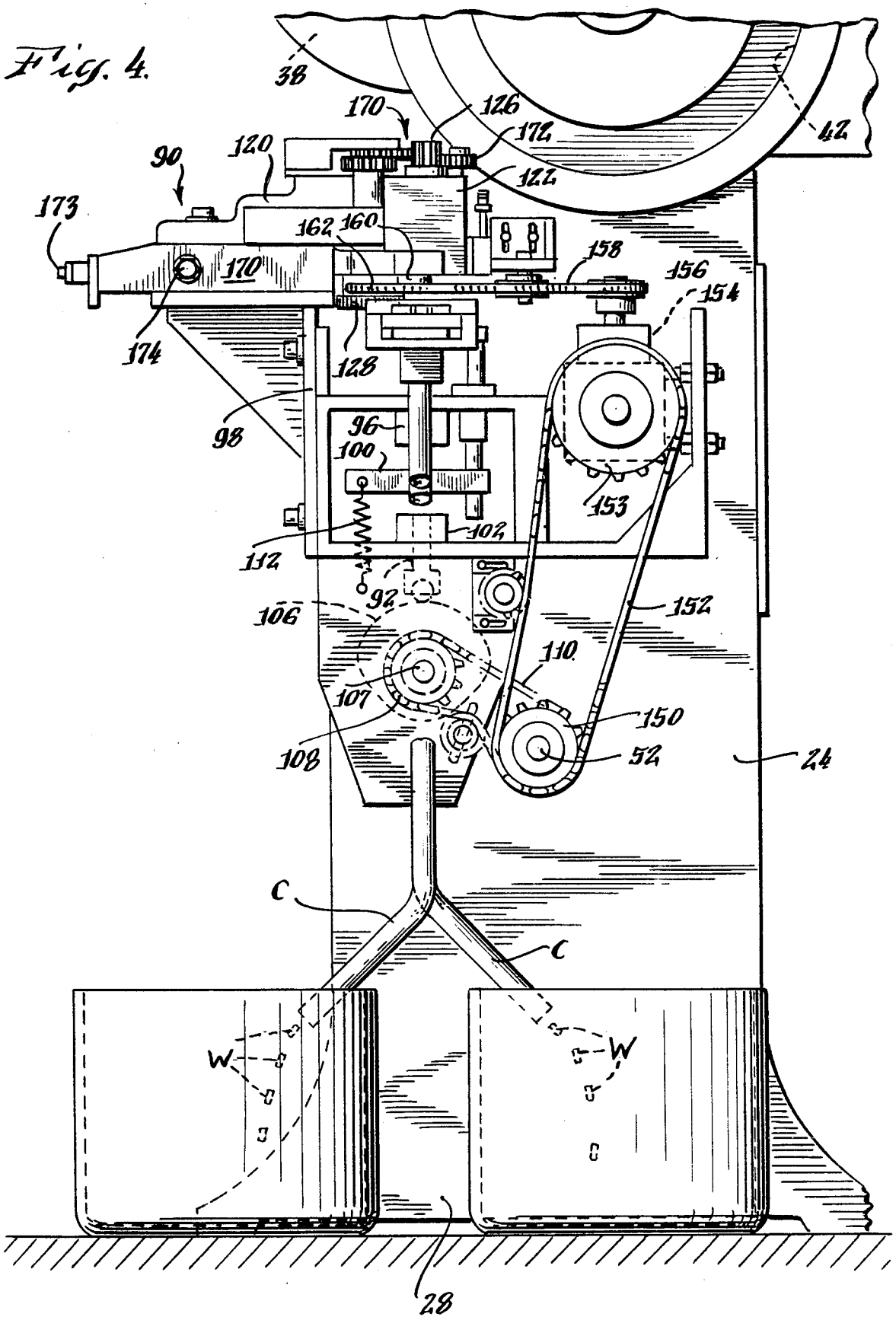
FIG. 4 is an end elevational view, parts being broken away for purposes of better clarity, of the workpiece discharge end at the right of the press seen in FIG. 1.
Figure 5:
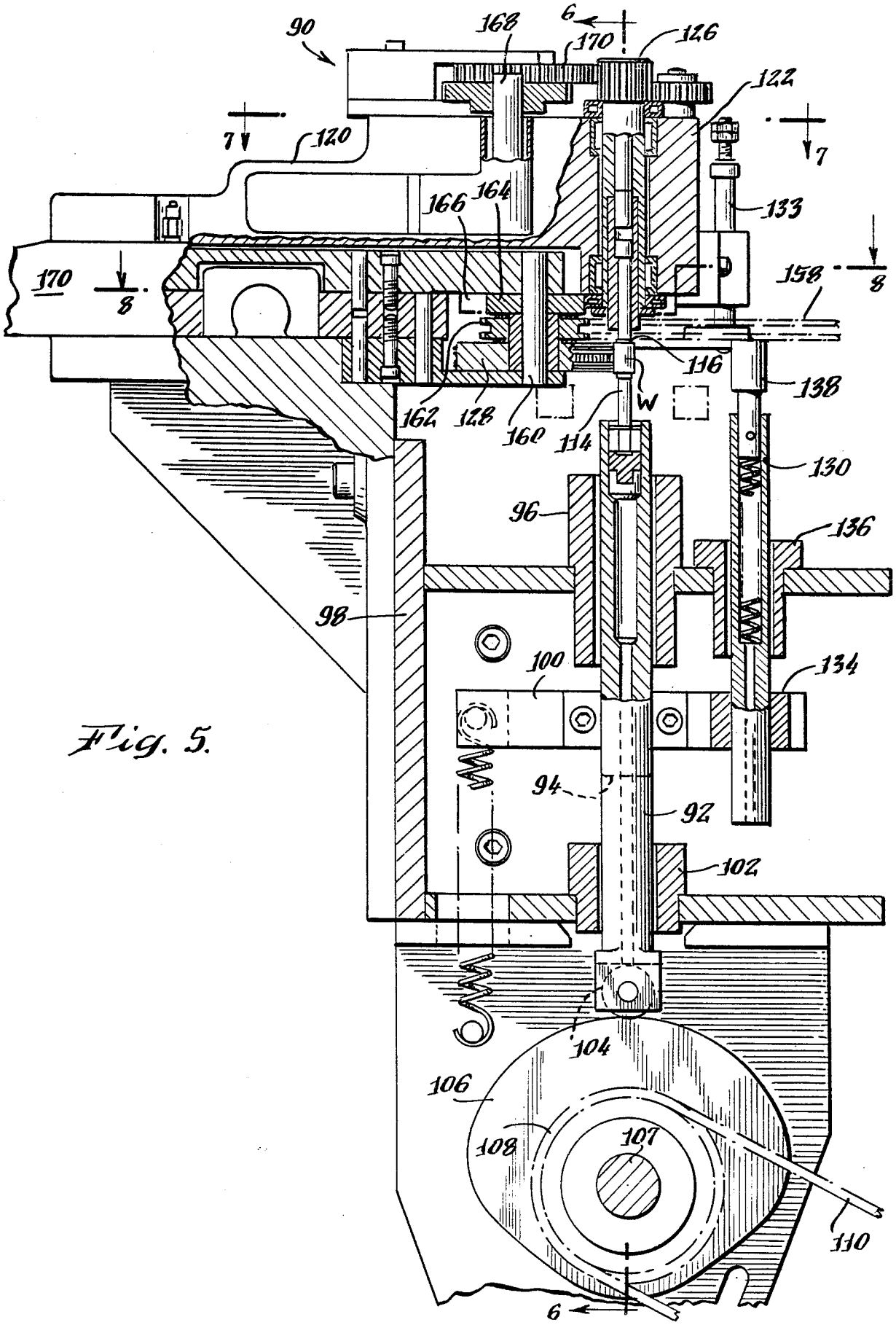
FIG. 5 is a cross sectional view through the press generally along line 5—5 of FIG. 1, transversely of the direction of workpiece travel, showing details of one of the rolling stations.
Figure 6:
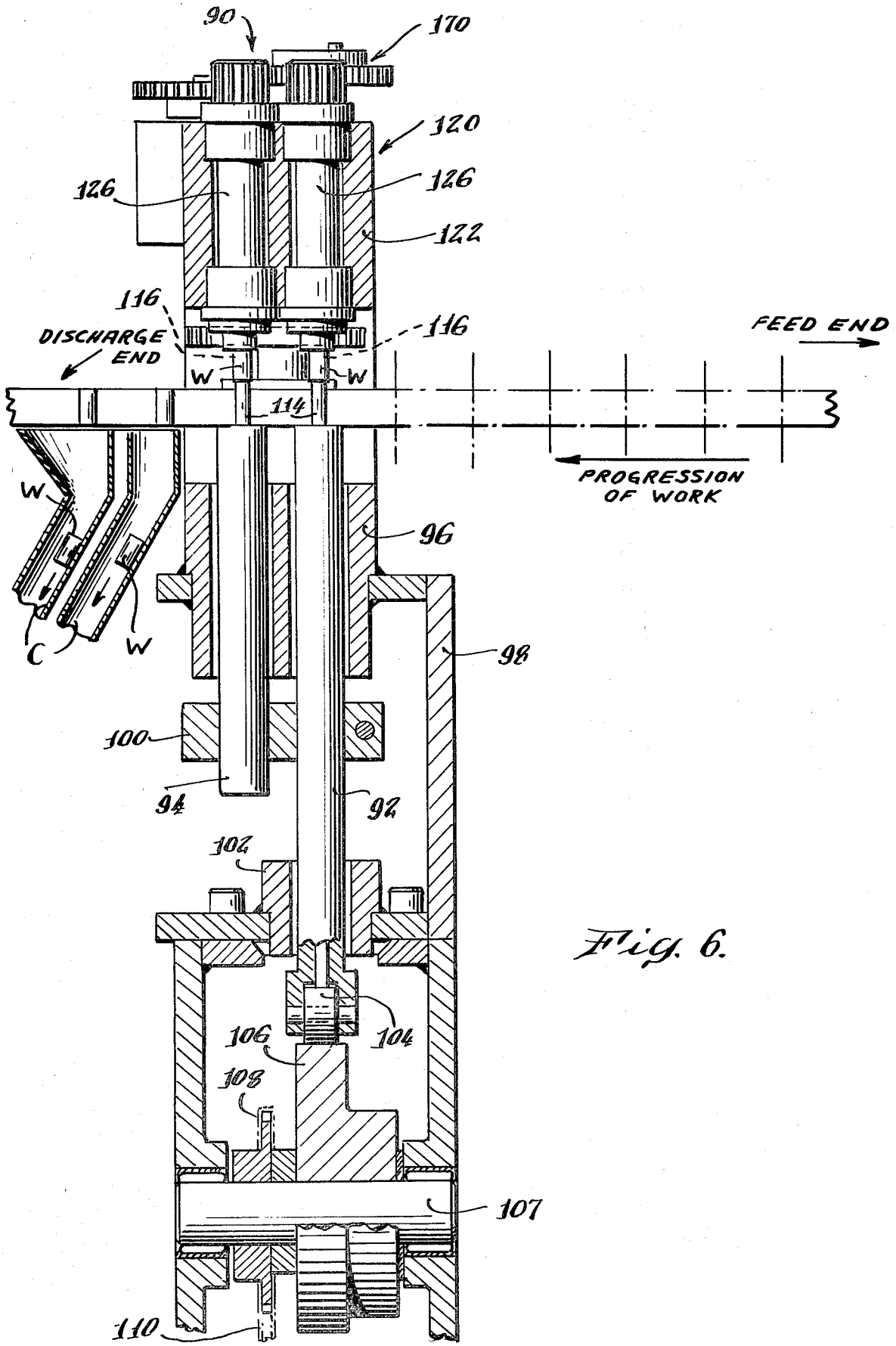
FIG. 6 is an elevational view in partial cross section taken along line 6—6 of FIG. 5.

With reference to FIGS. 4 through 8, and particularly to FIGS. 4, 5 and 6 for the moment, the roll forming mechanism at Stage X is designated generally at 90. This mechanism includes a number of main components including paired auxiliary plungers 92, 94, located beneath an extension of the press bed. Roll forming plungers 92, 94 are supported for vertical reciprocation in bushings 96 carried by a frame 98 secured to the end of press bed 30. Plunger 94 is shorter than and is attached to plunger 92 by a clamping bracket 100 which supports it in spaced parallel relation and moves it in unison with the longer plunger. Plunger 92 is further supported at its lower end by a second bushing 102, and is provided with a cam roller 104. Roller 104 contacts the surface of a horizontally journaled auxiliary cam 106 on shaft 107, the latter being driven by an associated sprocket 108. This in turn is driven by roller chain 110 from sprocket means (not shown) keyed to the lower main (knockout) shaft 52. An extension spring 112 secured between clamping bracket 100 and frame 98, maintains contact of cam roller 104 with cam 106 during reciprocation of the plungers.

At their upper ends, plungers 92, 94 have pilot pins 114 (see FIGS. 5 and 6) selected in accordance with the size and shape of the workpieces. The pins contact the workpieces as plungers 92, 94 rise and push the pieces from their clamped position between paired fingers 78 of the transfer means 66 upwardly onto registering work arbors 116 of an overhead assembly.

Figure 9:
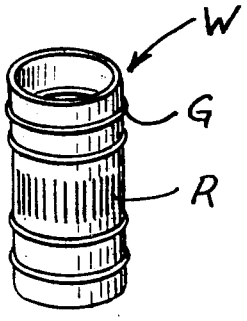
FIG. 9 illustrates a typical workpiece.

For the sake of illustration, the workpieces W shown in the drawings are eraser ferrules of the type used on wooden pencils. A typical form of such ferrule is shown in FIG. 9 and is commonly a thin-walled metal sleeve, something more than one-half inch long and approximately one-quarter inch in diameter. The sleeve is open at both ends and its wall adjacent the ends is formed with circumferential grooves G and axial ribs R to increase the grip of the ferrule on the pencil and eraser when assembled therewith.

The head of roll forming mechanism 90 is composed of a frame 120 having a bearing block 122 in which paired work arbors 116 are carried by spindles 126 so that the lower ends of arbors 116 terminate just above the level of the upper edges of workpieces W as these are advanced by transfer fingers 78. Arbors 116 are appropriately sized to receive the workpieces W which are slid upwardly onto them by pilot pins 114 with the rise of plungers 92, 94. The upper ends of pilot pins 114 of the plungers contact the lower ends of the respective arbors 116 throughout the roll forming operation, this being effected by an appropriately contoured surface of cam 106 to produce the required dwell. Such end-to-end contact of pins 114 and arbors 116 assures retention of the work in proper position on the arbors.

Figure 7:
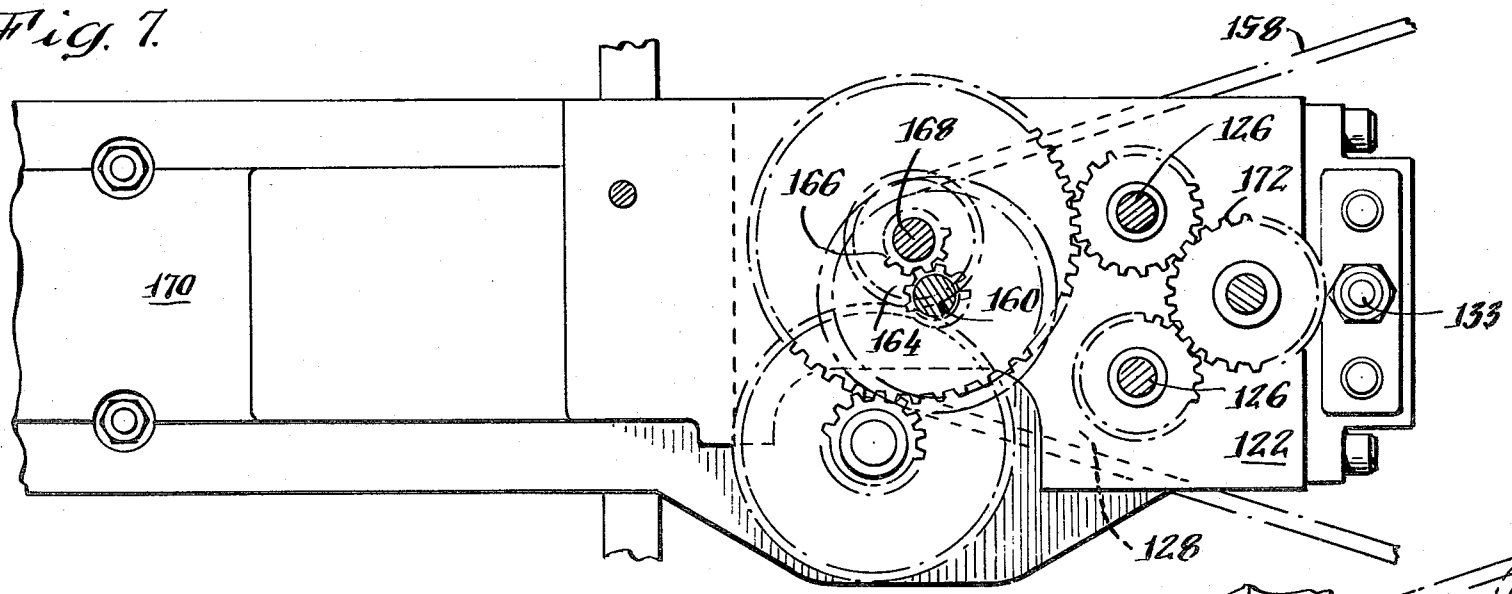
FIG. 7 is a plan view in section on line 7—7 of FIG. 5 of the head of the rolling station, and drive arrangement for the spindles thereof.
Figure 8:
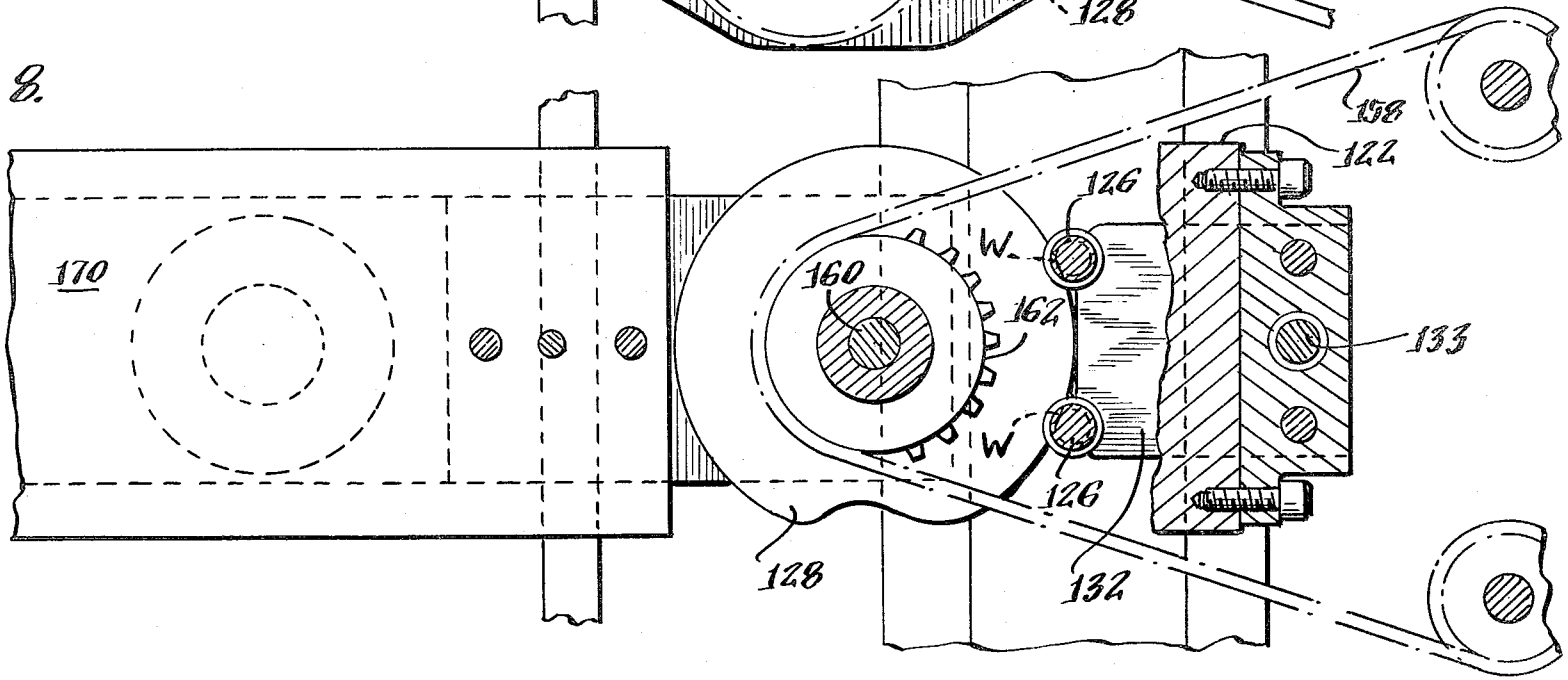
FIG. 8 is also a plan view in section on line 8—8 of FIG. 5 showing further details of the rolling station.

As best seen in FIGS. 5, 7 and 8, arbors 116 are positioned in frame 120 to cause the workpieces W to come into contact with a forming roll 128 which has an arcuate portion of its periphery configured to produce the grooves G and ribs R on the ferrules, shown in FIG. 9. Both the arbor spindles 126 nd forming roll 128 rotate continuously, even during transfer of the workpieces to the arbors. However, the rotational position and arcuate extent of the configured portion of the surface of forming roll 128 is timed by its drive train, in relation to the arrival of the workpieces, such that the latter are slid onto the arbors at a point in the rotation of forming roll 128 when its surface adjacent the arbors (workpieces) has no forming configuration; i.e., there is a small clearance between the surface of roll 128 and workpieces W which allows them to be slid freely onto arbors 116 of spindles 126. The rotation of forming roll 128 and the peripheral extent of its configured surface is designed to produce forming contact of the workpieces in one full revolution of arbors 116, thus completing the forming operation entirely around each workpiece during its retention on its arbor within the dwell time produced by cam 106.

At the conclusion of each cycle of the foregoing operation, plungers 92, 94 return to their low positions, retracting pilot pins 114 with them so that the workpieces W are no longer restrained against dropping axially off of arbors 116. However to ensure that the work is positively removed from the arbors, an extractor plunger 130 supported on a bracket 134 of clamping yoke 100 cooperates with a stripper plate 132 to effect this. Plate 132 is supported by a spring loaded plunger 133 above the work. Extractor plunger 130 is guided for vertical movement in parallel unison with plungers 92, 94 by a bushed bearing 136 on frame 120. Plunger 130 is hollow at its upper end and carries a spring loaded piston 138 which provides for a lost motion engagement with stripper plate 132. As the roll forming plungers 92, 94 rise, causing the extractor plunger 130 to rise also, the underside of stripper plate 132 is engaged by piston 138, lifting stripper plate 132 which is spring biased downwardly. On the return stroke of plunger 130, the stripper plate is released and strips the workpieces downwardly off the respective arbors 116. The pieces drop into chutes C at the discharge end of the press.

The foregoing operations are cyclically repetitive in conjunction with the rest of the blanking and drawing operations occurring simultaneously at the other tool stations on the press. The synchronization of the rolling and punch/draw operations is most readily accomplished by using the same press motor 46 to supply the drive for all of the operations including the rolling. Like the forming plungers 92, 94, forming roll 128 and arbor spindles 126 are powered by a take-off from lower shaft 52 of the press. This take-off comprises drive sprocket 150 on shaft 52, at the discharge end of the press, driving a roller chain 152 connected to the input sprocket of a right angle drive 154 which transmits power to each of spindles 126 and forming roll 128 by a roller chain and reducing gear train, as best seen in FIGS. 4, 7 and 8.

This train includes an output sprocket 156 on right angle drive 154 which transmits power by roller chain 158 to shaft 160 (on which forming roll 128 is mounted) through sprocket 162 keyed to this shaft just above roll 128. A pinion 164 on shaft 160 meshes with a pinion 166 on an overhead stub shaft 168 through which power is transmitted to a gear train indicated generally at 170. This delivers power to spindles 126 through a common gear 172 (see FIG. 7) to provide the positive timing relation between the spindle rotation and the forming roll, as described above.

In the embodiment of the invention just described and illustrated in the drawings, a single forming roll serves for both workpieces at Station X. This is a preferred construction, although individual forming rolls might be employed. In order that uniform or equal roll forming of both workpieces be accomplished simultaneously with a single roll, the invention includes provision for adjustment of the forming roll intermediate the work arbors. In the illustrated example, the forming roll 128 is journaled on its shaft in a heavy arm 170. See FIGS. 5, 7 and 8. This arm is pivotablly and longitudinally adjustable on frame 120 and carries forming roll 128 at its forward (free) end, whereby the location of the forming roll axis can be moved to adjust its radial distance from each of the axes of the work arbors 116 while still remaining parallel thereto. This positioning of arm 170 is effected by a pin and slot arrangement having longitudinal and lateral adjusting and locking screws 172, 174 (FIGS. 1 through 4) to effect vernier movement and secure the arm in desired position.

The foregoing description of the preferred embodiment serves to illustrate the invention concept, and it will be apparent to those skilled in the art that various changes can be made in details of the machine construction that will afford equivalent results falling within the scope of the appended claims.

What is claimed is:

1. A multistation transfer press for repetitive cycles of blanking and forming metal workpieces from a continuous metal strip fed to the press, wherein the forming involves a rolling operation on the workpieces, said press comprising a frame having a press bed and a plurality of tool stations arranged seriatim thereon to define a single file progression path along which the workpieces are advanced stepwise between successive blanking/forming operations;

blanking/forming tools positioned along said progression path, said tools being disposed in paired duplicate sets at adjacent tool stations;

ram means carried on said press frame, and driving means for reciprocating said ram relative to said press bed, each tool of said paired sets having a punch portion reciprocated by said ram relative to a cooperating die portion supported in said press bed to effect simultaneous blanking/forming operations at each of said paired stations;

reciprocable transfer mechanism on said frame for simultaneously advancing workpieces from station to station, and means for actuating said transfer means to advance each workpiece a distance equal to the distance between corresponding tools of each paired set;

drive means for operating said reciprocable ram and transfer mechanism.

said press having paired rolling stations each having spindles with workpiece receiving arbors at respective free ends thereof, means supporting said spindles with their arbors positioned above and in registry with paired workpieces delivered to said rolling station by said transfer mechanism;

a pair of plungers having free ends cooperating with said arbors, said plungers being axially aligned therewith and supported in said press with their free ends facing the free ends of said arbors but normally positioned below paired workpieces delivered by said transfer mechanism;

means for reciprocating said plunger free ends axially toward and away from said arbors, and means carried by said plungers for pushing workpieces upwardly from said transfer mechanism out said spindle arbors;

forming roll means cooperating with said arbors to engage said workpieces and roll form them; and drive means producing relative rotation of said arbors and forming roll means to effect said roll forming of said workpieces.

2. A multistation transfer press as defined in claim 1, wherein said roll forming station comprises the last in the sequence of stations along said press.

3. A multistation transfer press as defined in claim 1, wherein said drive means producing relative rotation of said arbors and forming roll means is operatively connected to and powered by said drive means for said reciprocable ram and transfer mechanism.

4. A multistation transfer press as defined in claim 3, wherein said workpiece arbor and forming roll drive means comprises a continuous gear train producing positive timed relative rotation between said arbor and roll in which said forming roll completes its forming operation circumferentially of the workpieces on said arbors within each said repetitive cycle of press operation.

5. A multistation transfer press as defined in claim 1, wherein said forming roll means constitutes a single forming roll having its axis parallel to but between the axes of said arbors so as to effect peripheral contact of said forming roll with workpieces positioned on both arbors of said rolling stations.

6. A multistation transfer press as defined in claim 5, wherein said forming roll means includes means for adjusting the radial distance of said forming roll axis to said workpiece arbors.

* * * * *